US007149319B2

(12) United States Patent
Roeck

(10) Patent No.: US 7,149,319 B2
(45) Date of Patent: Dec. 12, 2006

(54) TELECOMMUNICATION SYSTEM, SPEECH RECOGNIZER, AND TERMINAL, AND METHOD FOR ADJUSTING CAPACITY FOR VOCAL COMMANDING

(75) Inventor: Hans-Ueli Roeck, Hombrechtikon (CH)

(73) Assignee: Phonak AG, Stafa (CH)

( * ) Notice: Subject to any disclaimer, the term of this patent is extended or adjusted under 35 U.S.C. 154(b) by 124 days.

(21) Appl. No.: 09/767,444

(22) Filed: Jan. 23, 2001

(65) Prior Publication Data

US 2002/0021814 A1 Feb. 21, 2002

(51) Int. Cl.
*H04R 25/00* (2006.01)

(52) U.S. Cl. ..... 381/314; 381/313; 381/312

(58) Field of Classification Search ..... 381/312, 381/313, 314, 315, 323, 311, 316, 317; 379/52, 379/430, 428.02

See application file for complete search history.

(56) References Cited

U.S. PATENT DOCUMENTS

| | | | | | |
|---|---|---|---|---|---|
| 4,049,930 | A | * | 9/1977 | Fletcher et al. | 381/312 |
| 4,193,120 | A | * | 3/1980 | Yello | 381/120 |
| 4,425,481 | A | * | 1/1984 | Mansgold et al. | 381/313 |
| 4,774,515 | A | * | 9/1988 | Gehring | 340/120 |
| 4,847,763 | A | * | 7/1989 | Moser et al. | 128/746 |
| 5,276,739 | A | * | 1/1994 | Krokstad et al. | 381/312 |
| 5,719,528 | A | * | 2/1998 | Rasmussen et al. | 381/312 |
| 5,721,783 | A | | 2/1998 | Anderson | |
| 5,835,610 | A | * | 11/1998 | Ishige et al. | 381/315 |
| 6,023,517 | A | * | 2/2000 | Ishige | 381/315 |
| 6,047,074 | A | * | 4/2000 | Zoels et al. | 381/313 |
| 6,084,516 | A | | 7/2000 | Yasushi et al. | |
| 6,115,478 | A | * | 9/2000 | Schneider | 381/314 |
| 6,128,392 | A | * | 10/2000 | Leysieffer et al. | 381/318 |
| 6,144,748 | A | * | 11/2000 | Kerns | 381/312 |
| 6,226,533 | B1 | * | 5/2001 | Akahane | 455/566 |
| 6,320,969 | B1 | * | 11/2001 | Killion | 381/323 |
| 6,366,791 | B1 | * | 4/2002 | Lin et al. | 455/567 |
| 6,423,892 | B1 | * | 7/2002 | Ramaswamy | 84/609 |
| 6,466,801 | B1 | * | 10/2002 | Leyendecker | 455/550 |

FOREIGN PATENT DOCUMENTS

| | | | |
|---|---|---|---|
| DE | 100 40 660 A 1 | | 2/2002 |
| WO | WO 97/01314 | * | 1/1997 |
| WO | WO 00/22874 | | 4/2000 |
| WO | WO 00/41440 | * | 7/2000 |

OTHER PUBLICATIONS

Patent Abstract of Japan, "Hearing Aid," vol. 1997, No. 09, Sep. 30, 1997 & JP 09 139999 A, published May 27, 1997, Inventor: Ito Kenzo.

* cited by examiner

*Primary Examiner*—Rexford Barnie
(74) *Attorney, Agent, or Firm*—Pearne & Gordon LLP

(57) ABSTRACT

Time-limited electrical audio signals are fed to an electromechanical output transducer in addition to the signals from the hearing aid input. Some of the time-limited audio signals are user-defined. The process is implemented in a hearing aid having an electromechanical transducer and a signal processor. An audio signal generator has a user-changeable memory and/or a read/write memory that can be programmed by the user.

38 Claims, 3 Drawing Sheets

TELECOMMUNICATION SYSTEM, SPEECH RECOGNIZER, AND TERMINAL, AND METHOD FOR ADJUSTING CAPACITY FOR VOCAL COMMANDING

This invention concerns a process for communication between a hearing aid and an individual and a hearing aid system with at least one hearing aid. These types of processes and hearing-aid systems are known. Thus, for example, it is known how to acknowledge manual input on a therapeutic hearing aid, especially an outside hearing aid, as for example with toggle switches, by means of synthesized beep signals, which are fed to the electromechanical output transducer of the hearing aid as electrical audio signals.

Today's therapeutic hearing aids mark the individual who must have such help with a certain stigma of disability, which is felt by young people in particular. So recently, people have tried to design hearing aids indicated for medical reasons aesthetically so they radiate a certain youthfulness or joy, and people do not necessarily have a tendency to hide their handicap by hiding and concealing the device. As part of this increased attractiveness, the goal of this invention is to make communication between the hearing aid and an individual more attractive and more fun.

This is done so that at least some of the time-limited audio signals are user-defined. Thus, now it is possible for each user—whether he/she is a user of a therapeutic hearing aid or a hearing aid from entertainment technology, like a headset, for example, with the required characteristics—to be able to choose the audio signals with which events are displayed or acknowledged on the hearing aid himself or herself.

In one preferred embodiment of the process in the invention, the time-limited electric audio signals are produced especially as acknowledgment signals to control signals, which control signals are produced for example manually or by remote control on the hearing aid or are triggered by the hearing aid itself, as for example when the battery voltage drops.

In one preferred embodiment of the process in the invention, at least some of the time-limited audio signals mentioned are stored on memory elements for the hearing aid that can be changed by the user, preferably on storage elements that are read only.

With it, the user can change the storage elements for stored audio signals according to his/her taste. These types of memory elements can be provided as read-only memory by the hearing aid manufacturer in a wide range of different audio signal patterns.

In another preferred embodiment that, if necessary, supplements the last embodiment mentioned, the time-limited audio signals mentioned are user-defined and filed in a storage unit that can itself be built into the hearing aid or is connected to it, preferably wirelessly, or can be brought into working contact with it. In this embodiment, the audio signals mentioned are stored selectively and defined by the user in his/her own hearing aid and can be changed accordingly.

In a third embodiment, which can be combined if necessary with the previously mentioned embodiments, the only information filed in the actual hearing aid is the location where the audio signal sequences to be called up are on a predetermined audio signal carrier. This procedure requires that the user of the hearing aid carry an audio player on him/her, like for example a minidisk player, an MP3 player, etc. Communication between the hearing aid, on one hand, and such a player, on the other, is preferably wireless.

Another preferred embodiment of the process in the invention, in which the output transducer mentioned is a loudspeaker, proposes that at least some of the time-limited electrical audio signals mentioned be produced so that the results of their acoustic transducer can be heard by an individual at a distance as well. Thus, it is possible to transmit information to a user by corresponding acoustic signals even when the hearing aid is not being worn. This can be the case, for example, when the battery voltage drops or when the hearing aid is stored improperly but can be detected, etc.

In another preferred embodiment, the user-defined selection of time-limited electrical audio signals is menu-driven. For this, a communications unit is provided that preferably has a wireless working connection to the hearing aid and leads the user through the selection menu with a visual display and/or by voice.

If the communication unit mentioned is also designed at least for voice control, it is also proposed that the voice control be created via the hearing aid mentioned by storing the corresponding voice signals in the hearing aid.

Provided in one embodiment is a hearing aid system with at least one hearing aid, which contains:

- a signal-processing unit (3) which is connected on the output side to
- an electromechanical transducer with a working connection,
- an audio signal generator unit, whose output also has a working connection to the input of the electromechanical transducer (5), characterized by the fact that the audio signal generator unit (9, 9*a*, 9*b*) has a user-changeable memory (20, 11*a*) and/or a read/write memory (9*a*) that can be written on by the user.

In another embodiment, the above system is characterized by the fact that the audio signal generator unit (9, 9*a*, 9*b*) has an addressing input (I) for the memory (20, 9*a*), which has a working connection with control signal-producing organs (7, 3) in the hearing aid.

In another embodiment, the system above is further characterized by the fact that the production unit includes manually activated switching organs (M) on the hearing aid and/or organs having a working connection to a remote-control input of the hearing aid and/or the signal-processing unit (3).

Still further, the systems above can be further characterized by the fact that the read/write memory is designed for user-defined storage of audio-signal sequences of a predetermined length or the fact that the write input of the read/write memory can or does have a working connection to or has a working connection to an audio signal source.

In addition, the system above can be characterized by the fact that the audio source I is an audio player or a unit with an Internet connection.

Any of the above systems can be further characterized by the fact that it includes a display unit for visual and/or voice-controlled menu control, which has or can have a working connection to the control-signal-producing organs of the hearing aid, on one hand, and to the audio-signal generator unit on the other.

The system above can be even further characterized by the fact that the display unit is designed for voice control by menus and has a working connection on the output side with the input of the electromechanical transducer of the hearing aid.

The invention will be described next with examples using the figures.

Figure 1:
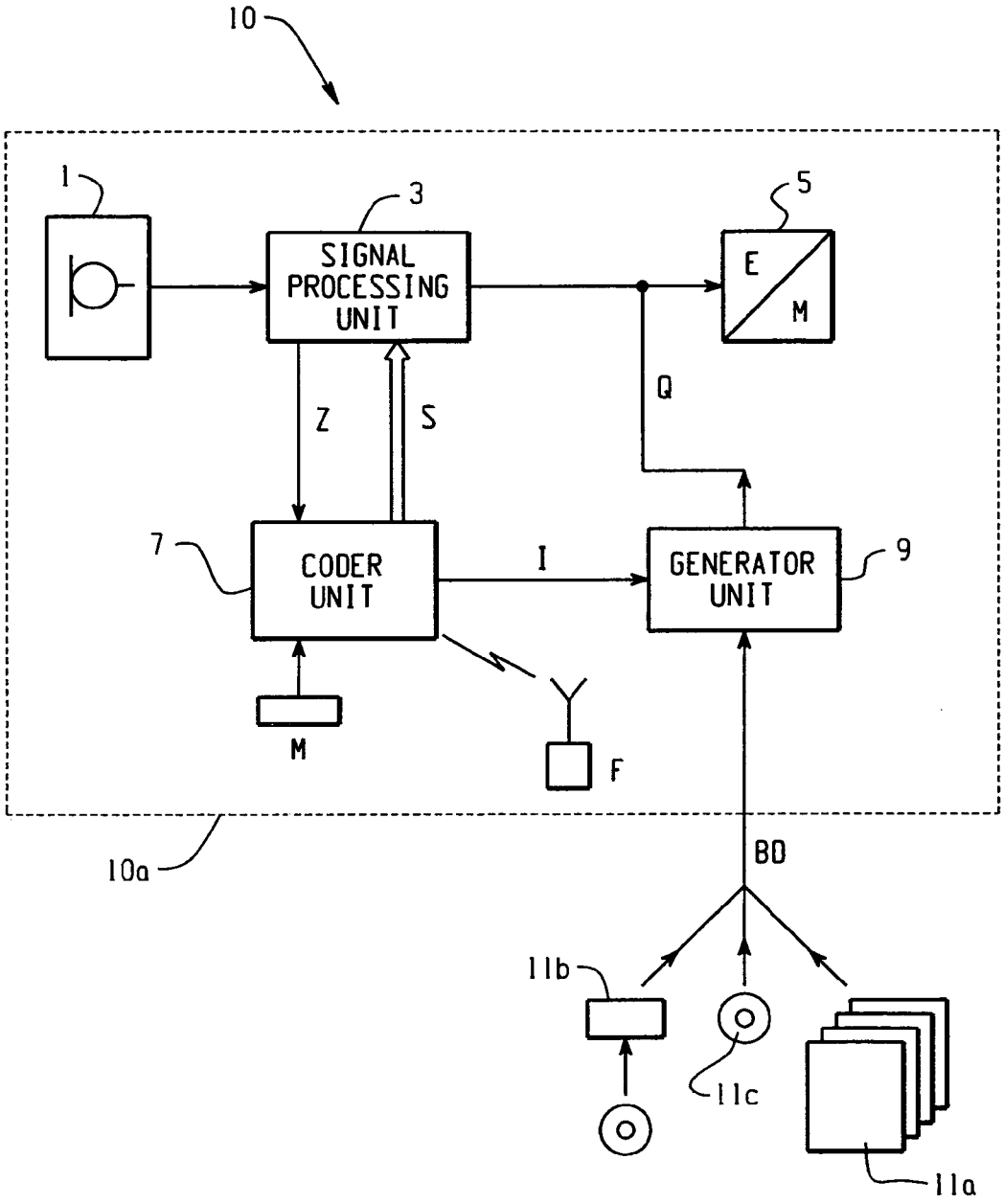
FIG. 1 shows the principle behind the process in the invention and the hearing aid in the invention using a simplified signal flow/function block diagram.
Figure 2:
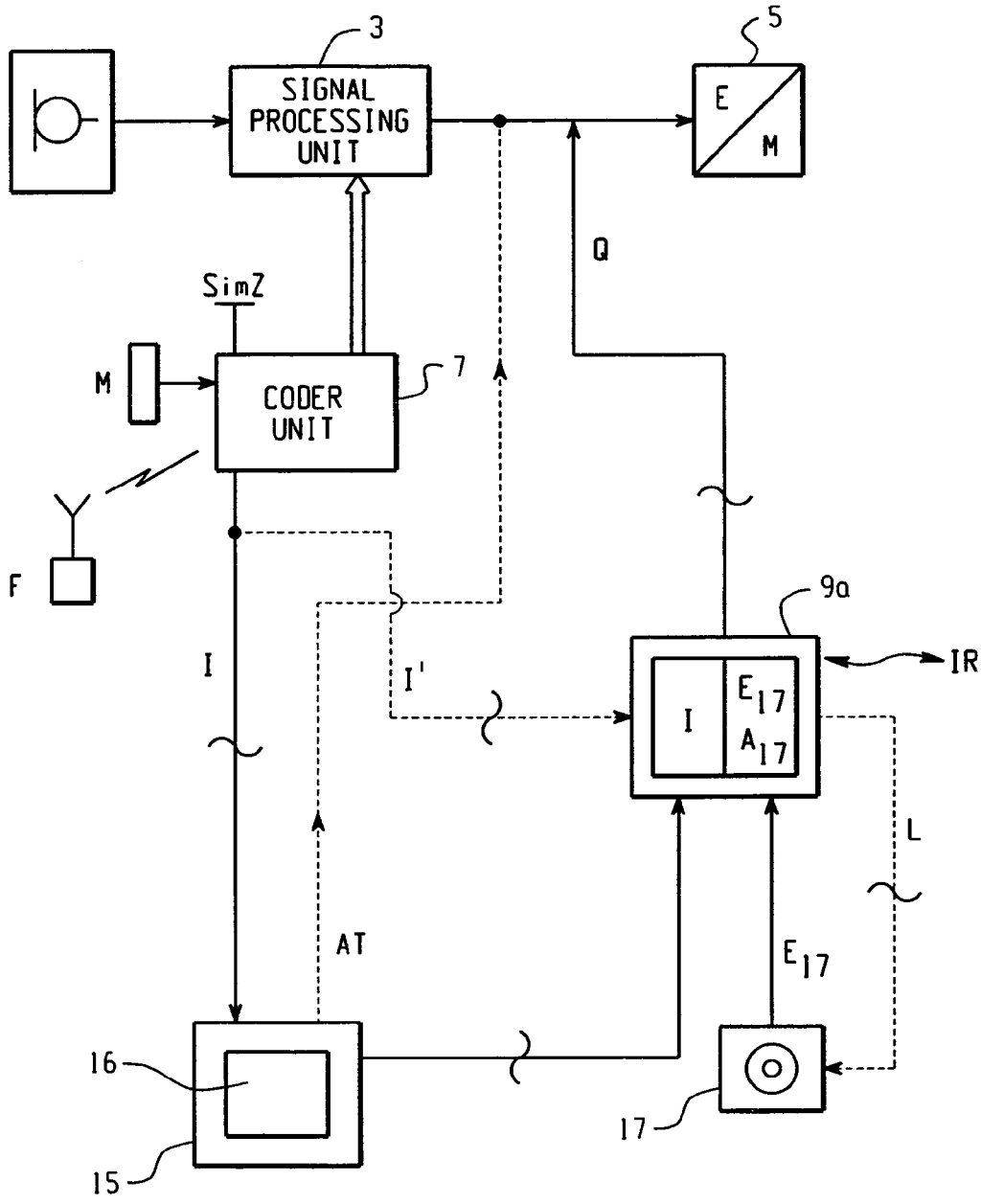
FIG. 2 shows a view similar to the one in FIG. 1 of preferred embodiments of the process and hearing aid system in the invention.
Figure 3:
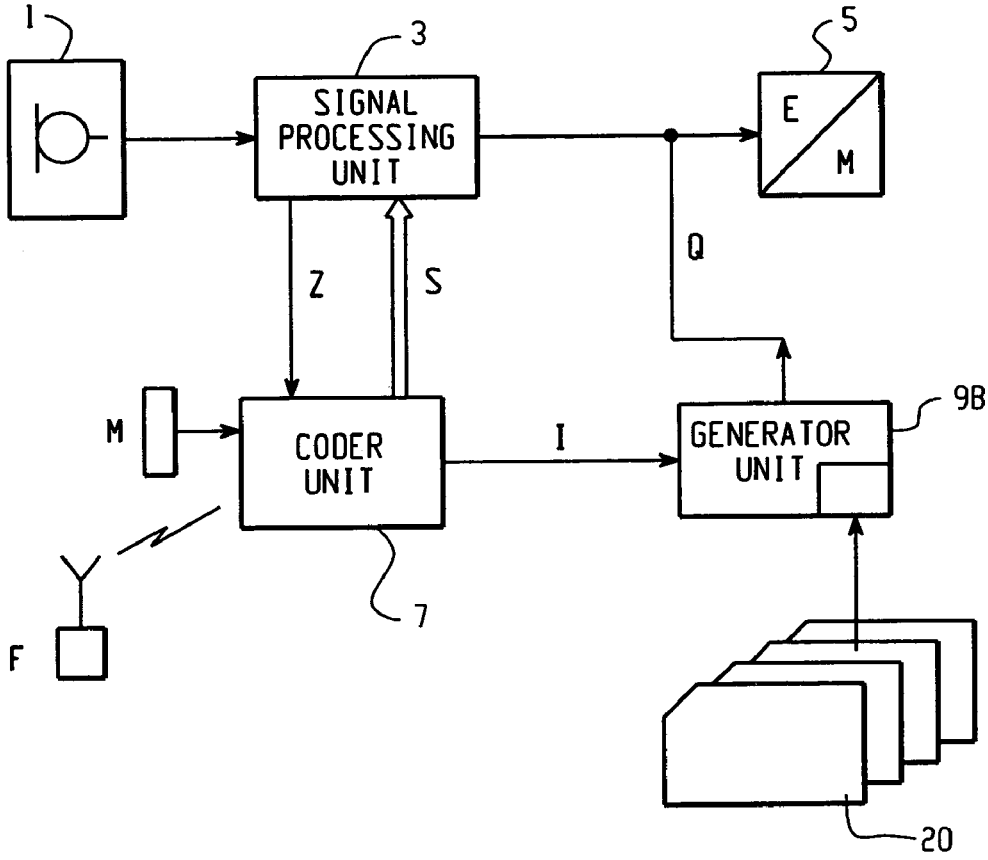

FIG. 3 in turn shows a view like the one in FIGS. 1 and 2 of another preferred variation of the process and the hearing aid system in the invention.

FIG. 1 shows the principle behind this invention using a block diagram of the signal flow/function. A hearing aid system 10 includes a hearing aid in itself, with an acoustic/electric input transducer unit 1 and its usually digital signal-processing unit 3 connected after it, which works on an electrical/mechanical transducer unit 5 at the output. This is an at least partly implanted therapeutic hearing aid 5, so the electrical/mechanical transducer unit 5 is a unit that works mechanically on an ossicle in the middle ear, while on a regular therapeutic in-the-ear or out-of-the-ear hearing aid, the transducer unit mentioned is composed of a loudspeaker unit. Besides being a device for therapeutic purposes, the hearing aid can also be a device not used for therapeutic purposes, like for example a headset.

The signal-processing unit 3 of the actual hearing aid receives control signals S of all kinds, like for example program-switching signals, signals to adjust the volume transmitted, hence basically signals that trigger the signal-processing changes desired by the respective individual when the hearing aid is used. As shown schematically in FIG. 1, these types of signals S are input manually, M, like for example those triggered by pressing switches, or if remote control is provided, are usually wireless, as shown at F. FIG. 1 is a schematic view of the conversion of manually input signals M or signals F transmitted wirelessly into control signals for the signal-processing unit 3 on a coder/decoder unit 7. To this extent, the measures taken on hearing aids, especially therapeutic ones, are known thus far.

It is also known that, as a function of the signals input, as mentioned, manually—M—or by remote control—F—on the hearing aid 10*a*, acoustic acknowledgment signals that can be perceived by the individual are produced, in the form of characterizing sequences of beep signals. As a function of the control signals input manually M or by remote control F, the coder unit 7 calls up the acknowledgment signals Q assigned to the control signals M, F on a generator unit 9 and feeds them to the electromechanical transducer unit 5 on the input side and converts them into corresponding signals that can be heard by the individual. Thus, the actual hearing aid 10*a* is always made up of units 1, 3, 5, 7 and 9 and their signal connections, as shown in FIG. 1.

The generator unit 9 provided in these types of known hearing aids is designed as an actual read-only unit, where the acknowledgment signals fed to the transducer unit 5 are stored.

Basically, the invention now proposes that on the generator unit 9, in the sense of a read-only storage, the acknowledgment signals Q mentioned no longer be prestored at the factory and fixed, but that these signals can be stored and user-defined. The acknowledgment signals Q assigned to the control signals M, F can be freely selected by the individual using the respective hearing aid and changed in any way he/she likes.

Here, the audible user-defined signals that correspond to the electrical acknowledgment signals Q can be voice sequences, music sequences, noises for example,. The system in the invention can now be designed so that:

- if necessary, the respective user-defined acknowledgment signals can be called up in time, practically online, directly from a tape recorder, preferably by wireless transmission and converted on the generator unit 9 into the electrical acknowledgment signals Q specifically needed by the device,
- the acknowledgment sequences the user wants are selected in advance and are preferably stored directly in the hearing aid;
- storage is offered, for example, by the hearing aid manufacturer, on chips for example, and sequences matched to the signals M and F being acknowledged depend on taste and are prestored.

Provision is made so the user-defined signal sequences desired can be stored in the hearing aid or these types of signals can be defined on audio carriers, so this is preferably menu-driven, as will still be explained.

FIG. 1 show the basic approach the invention takes through the signal input BD to the generator unit 9, whereby the user-defined acknowledgment signals Q mentioned are input, whether by user-defined entry of predefined data-storage 11*a*, or by storage of user-defined stored sequences 11, or by user-defined storage of audio carriers 11*c*.

As can also be seen from FIG. 1, it is completely possible for statuses like a drop in battery voltage under predetermined values to be signaled to the user by the signal-processing unit 3. Then, the input is to the coder unit 7 by the signal-processing unit 3, as shown by Z. As already explained, a corresponding user-defined acknowledgment signal Q is then also transmitted to the transducer unit 5 and the appearance of the signal Z is displayed to the user with a corresponding user-defined signal.

If necessary, the acknowledgment signal Q can be designed in such a way that on hearing aids with loudspeakers outside, the corresponding audio signals are audible, even if the hearing aid is not even being worn. For example, status-reporting signals Z, which display for example the battery status or how that the hearing aid is being stored in an area where the temperature is too high, etc. can be used by the signal-processing unit 3 to call up a corresponding acknowledgment signal Q, which also gets the user's attention when the hearing aid is stored away from him/her, and leads to the corresponding action.

FIG. 2, which is a schematic view, in simplified form, of a block diagram of the signal flow/function of a preferred hearing aid system according to the invention that works by the process in the invention, should explain how a user selects user-defined menu-driven audio sequences and, if necessary also stores them.

In the selection mode for the acknowledgment sequences, the signals I identifying the signal input—manual M—or wireless F—already shown in FIG. 1, of an external display unit 15 with display 16 or with synthetic speech output (not shown), thus for example a laptop, a computer or a remote-control unit are fed to the coder unit 7 on the output side. When the respective identification signal I comes by manual input M or remote input F, the following text is displayed or spoken on the unit 15, for example:

"Please select the acknowledgment signal you want for the program circuit NORMAL ENVIRONMENT/CONCERT HALL. Its maximum permitted length is 5 seconds."

If the menu-driven text is spoken, then it is displayed, whether a hearing aid or a therapeutic hearing aid is used, to feed it [the text] to the transducer as shown in dashes in FIG. 2 at AT.

The user then turns on any audio signal source, like for example a tape recorder 17 or an Internet page, and in the predetermined length of time, for example 5 seconds, the sequence chosen by the user at the source, is fed to the generator unit 9*a* in the form of electrical signals $E_{17}$ and filed there assigned to the specific identification signal I. For this, the identification signal I is looped on the display unit 15 mentioned via the generator unit 9. In the generator unit 9*a*, in this design, the signal $E_{17}$ corresponding to the audio sequence selected, is preferably, but not necessarily stored in digital form.

That way, the audio sequences selected by the user for those signals input manually or by remote control, corresponding to M or F, for which user-defined acknowledgment signals Q are desired are stored with the assigned signals I triggering them in the generator unit 9.

When the hearing aid is operating, the display unit 15, if it is not a unit built-into a remote-control system, is removed, and as shown at I', the working connection is set up between the coder unit 7 and the generator unit 9.

But, if necessary, it can also be provided that the audio sequence selected, corresponding to $E_{17}$, is not stored in the generator unit 9 at all, but that only the data found $A_{17}$ for the respective sequence are recorded there on a tape recorder, assigned to the respective signal I. In this case, in operation, with the playback device with the tape recorder 17 worn on the individual, when an identification signal I appears, the generator unit 9, as shown in dashes at L, will control the playback unit for playing the audio sequences defined in the generator unit 9. Only then will the signal $E_{17}$ be fed by the generator unit 9 or if necessary directly to the transducer unit 5.

The signal paths marked by "~" in FIG. 2 can be based on wireless transmission. Thus, in the selection mode, the signal I can be transmitted wirelessly to the display unit 16, for example as an infrared signal or as a radio signal over a short distance. Likewise, the generator unit 9*a* can be made separately from the actual hearing aid 1, 3, 5, 7. The acknowledgment signal Q is then transmitted from the generator unit 9*a* wirelessly to the input of the transducer unit 5. Likewise, from the output of the coder unit 7, the respective signal I calling up an audio sequence is preferably transmitted wirelessly to the generator unit 9. Of course, in this case, transmitting and receiving units must be provided, according to wireless transmission techniques selected, on units 7, 9*a*, 15, 17 on the input side of the transducer unit 5 (not shown). As already explained using FIG. 1, should statuses recorded by the specific hearing aid 1, 3, 5 trigger acknowledgment signals Q corresponding to signals Z, on the selection menu for the corresponding audio sequences, the signals Z that can occur, should be simulated and, as was described, assigned to the respective audio sequences. Such simulation can be triggered, for example, by pressing a key on the hearing aid, as shown by SimZ in FIG. 2.

Even when only found data $A_{17}$ assigned to signals I are stored in the generator unit 9, which then call up audio sequences defined by a tape recorder 17 practically online, on the generator unit 9*a*, in the sense of a read/write memory, there is RAM data storage in a corresponding memory, and the found data mentioned can be changed at any time by the user, to assign other audio sequences to the respective control signals I as acknowledgment signals Q.

FIG. 3 shows another preferred embodiment of the hearing aid in the invention, which is fully integrated. The generator unit 9*b* here is part of the actual hearing aid, for which the desired acknowledgment signal/audio sequences and their user-changeable storage, like chips 20, for example, are chosen. Preferably, a selection of different acknowledgment signals is made available in memories 20, by means of which the user can select the style or sound structure he/she likes. By changing the memory 20, which is then desired preferably as a read-only memory ROM, the user selects which acknowledgment signals he wants to hear for the assigned switching signals M, F or Z.

With this invention, it will be possible for the user of both therapeutic hearing aids and also hearing aids from the entertainment industry, for example headsets, to stop using dry, technical acknowledgment signals like the known beep signals and to choose his/her personal acknowledgment signals. It is possible, with the process in FIG. 3 for example, for young people to exchange memories between them, or a preferably wireless interface is created between the generator units 9*a* of different hearing aid systems with the design in FIG. 2, as by infrared, to synchronize a generator unit 5 with the audio sequences of another hearing aid system, as shown in FIG. 2 by $I_x$.

What is claimed is:

1. A method for communicating between a hearing device including a user input for listening to first audio signals and an individual carrying said device, said method comprising the steps of:

providing a plurality of notification audio signals each having a corresponding predetermined duration;

a user selecting one of said plurality of notification signals, using the user input, for associating with a status of the device; and applying to an output converter of said hearing device said selected notification signal for notifying the user of the status of said hearing device.

2. The method of claim 1, further comprising the step of storing said at least one of said notification signals on a user exchangeable storage element.

3. The method of claim 1, further comprising the step of storing said at least one of said notification signals in a storage unit and operationally connecting said storage unit and said hearing device by a wireless link.

4. The method of claim 1, wherein said at least one of said notification signals is generated so that it is audible by an individual remote from said hearing device.

5. The method of claim 1, wherein more than one of said notification signals is provided and further wherein said selecting of said notification signals to be activated is provided in a menu-controlled manner.

6. The method of claim 5, wherein the step of performing said selecting is done via a remote communication unit for said hearing device.

7. The method of claim 6, further comprising the step of establishing a wireless communication between said communication unit and said hearing device.

8. The method of claim 6, wherein the step of performing said selecting is done in a speech controlled manner.

9. A hearing device system with at least one hearing device, said hearing device comprising:

an electrical/mechanical converter;

an input for a user to select one of a plurality of notification audio signals for associating with a system status;

a signal processing unit with an output being operationally connected to an input of the electrical/mechanical converter; and a generator unit an output of which is also operationally connected to said input of said converter, said generator unit including a user exchangeable storage for storing one or more of said plurality of notification signals, wherein said generator unit provides said selected notification signal to said converter to notify the user of the status of the system status.

10. A hearing device system comprising:

at least one hearing device, said hearing device including:

an electrical/mechanical converter; and a signal processing unit with an output being operationally connected to an input of said electrical/mechanical converter;

an input for a user to select a user defined notification audio signal of predetermined extent for associating with a system status; and a generator unit the output of which is operationally connected to the input of said electrical/mechanical converter, said generator unit including a user writable read/write storage unit for storing said user defined notification audio signal to be output by said generator unit for notifying a user of a status of the system.

11. The system of claim 10, wherein a writing input of said read/write storage is operationally connected or is operationally connectable to a signal source of audio signals.

12. The system of claim 11, wherein said signal source is an audio playback unit or is a unit with internet connection.

13. The system of claim 10, further comprising a display unit for at least one of a visual or speech controlled menu, said display unit being operationally connected or connectable to a signal generator generating control signals for said device to said generator unit.

14. The system of claim 13, wherein said display unit is for speech control and has an output which is operationally connected to said input of said electrical/mechanical converter of said hearing device.

15. A method of acknowledging to an individual carrying a hearing device, said hearing device having:

an acoustical/electrical input converter unit having an output;

a signal processing unit having an input and an output;

an input for a user to select one of a plurality of acknowledgement audio signals for associating with a predetermined system status; and an electrical/mechanical output converter arrangement having an input, wherein said output of said input converter is operationally connected to said input of said signal processing unit, the output thereof being operationally connected to said input of said output converter arrangement, said method comprising the steps of:

generating an acknowledgement control signal in said hearing device whenever the predetermined status of said hearing device is reached; and initiating said selected acknowledgement audio signal according to said acknowledgement control signal to be applied to said input of said output converter, wherein said acknowledgement audio signal is made selectable by the individual.

16. The method of claim 15, wherein one or more of said acknowledgement audio signals is stored on a user exchangeable storage.

17. The method of claim 16, wherein said user-exchangeable storage is applied to said hearing device.

18. The method of claim 16, wherein said user-exchangeable storage is a read-only storage.

19. The method of claim 15, wherein said hearing device further has a storage unit for storing said audio signals.

20. The method of claim 15, further comprising a storage unit remote from said hearing device for said audio signals and establishing at least one of a wireless or of a wired communication between said hearing device and said storage unit.

21. The method of claim 15, wherein more than one of said audio signals are provided and wherein said user selectability comprises selecting which of said audio signals is initiated by said acknowledgement control signal.

22. The method of claim 15, wherein said selected audio signal is applied to said output converter of said hearing device so as to be audible even as said hearing device is not applied to an individual.

23. The method of claim 15, wherein said selection of said audio signal is performed in a menu-controlled manner.

24. The method of claim 15, further comprising the step of pre-selecting one of said audio signals, via a communication unit remote from said hearing device, for associating with said predetermined system status.

25. The method of claim 24, wherein there is established a wireless communication between said communication unit and said hearing device.

26. The method of claim 24, wherein said pre-selection of said audio signal is performed at said communication unit in a menu-controlled manner by means of at least one of visual and speech menu indications.

27. The method of claim 26, wherein said menu is communicated to said individual via said hearing device as a menu indication by voice.

28. The method of claim 15, wherein said selection of said audio signal is performed in a speech-controlled manner.

29. A system comprising at least one hearing device, said hearing device including:

an electrical/mechanical input converter arrangement having an output;

a signal processing unit having an input and an output;

an input for a user to select a notification audio signal for associating with a predetermined system status;

an electrical/mechanical output converter arrangement having an input; and a generator unit having:

an audio signal storage unit for storing the selected notification signal; and an output operationally connected to said input of said output converter arrangement;

wherein said output of said input converter arrangement is operationally connected to said input of said signal processing unit, and wherein said output of said signal processing unit is operationally connected to one of said input and another input of said output converter arrangement, and further wherein said hearing device generates at least one acknowledgement control signal when said predetermined status of said hearing device is achieved, and still further wherein said generator unit applies said selected notification audio signal to said output converter arrangement when initiated by said acknowledgement control signal of said hearing device.

30. The system of claim 29, said hearing device further comprising a manually operated switching member, wherein said acknowledgement control signal is initiated by said switching member.

31. The system of claim 29, said generator unit further including an addressing input for said audio signal, said acknowledgement control signal addressing via said addressing input said audio signal.

32. The system of claim 31, further comprising a remote control unit for said hearing device, wherein said acknowledgement control signal is initiated by a control action for said hearing device by said remote control unit.

33. The system of claim 32, wherein said remote control unit is operationally connected to said hearing device via at least one of a wired and of a wireless communication link.

34. The system of claim 29, wherein said generator is integrated in said hearing device.

35. The system of claim 29, wherein said generator unit is remote from said hearing device and there is provided a wired and/or wireless communication link between said hearing device and said generator unit.

36. The system of claim 35, wherein said generator unit is connectable to the internet.

37. The system of claim 29, further comprising a display unit for displaying at least one of a visually and of a speech controlled menu, said display unit being operationally connected or connectable to said generator unit and to said hearing device for establishing which of more than one of said audio signals shall be initiated by said acknowledgement control signal and/or which of more than one acknowledgement control signals shall initiate said audio signal.

38. The system of claim 37, wherein said display unit has an output for audio menu information signals, said output being operationally connected to said output converter of said hearing device.

* * * * *